US010081523B2

(12) United States Patent
Brown et al.

(10) Patent No.: US 10,081,523 B2
(45) Date of Patent: Sep. 25, 2018

(54) LOAD INDICATOR FOR VEHICLE LIFT

(71) Applicant: VEHICLE SERVICE GROUP, LLC, Madison, IN (US)

(72) Inventors: Doug Brown, Madison, IN (US); James G. Dirksen, Jr., Madison, IN (US); Kevin S. Katerberg, Madison, IN (US)

(73) Assignee: Vehicle Service Group, LLC, Madison, IN (US)

( * ) Notice: Subject to any disclaimer, the term of this patent is extended or adjusted under 35 U.S.C. 154(b) by 21 days.

(21) Appl. No.: 14/705,028

(22) Filed: May 6, 2015

(65) Prior Publication Data

US 2015/0329336 A1 Nov. 19, 2015

Related U.S. Application Data

(60) Provisional application No. 61/993,550, filed on May 15, 2014.

(51) Int. Cl.

| | |
|---|---|
| ***B66F 7/20*** | (2006.01) |
| ***B66F 7/28*** | (2006.01) |
| ***B66F 3/46*** | (2006.01) |
| ***B66F 17/00*** | (2006.01) |
| ***B66F 7/04*** | (2006.01) |
| ***B66F 7/16*** | (2006.01) |

(52) U.S. Cl.

CPC ..... *B66F 7/20* (2013.01); *B66F 3/46* (2013.01); *B66F 7/04* (2013.01); *B66F 7/16* (2013.01); *B66F 7/28* (2013.01); *B66F 17/00* (2013.01)

(58) Field of Classification Search

CPC ..... B66F 7/20; B66F 7/28; B66F 7/02; B66F 7/04; B66F 7/22; B66F 17/00

USPC ..... 254/89 H, 133 R

See application file for complete search history.

(56) References Cited

U.S. PATENT DOCUMENTS 2,805,839 A * 9/1957 Branick ..... B66F 3/30 254/2 B
4,531,614 A * 7/1985 Naegeli ..... B66F 7/04 187/208

(Continued)

FOREIGN PATENT DOCUMENTS

| | | |
|---|---|---|
| EP | 1 285 878 A1 | 2/2003 |
| EP | 2 708 489 A1 | 3/2014 |
| WO | WO 2004/026754 A2 | 4/2004 |

OTHER PUBLICATIONS

Dutch Search Report and Written Opinion dated Feb. 25, 2016 for Application No. NL 2014789, 8 pgs.

*Primary Examiner* — Christopher M Koehler
*Assistant Examiner* — Seahee Yoon
(74) *Attorney, Agent, or Firm* — Frost Brown Todd LLC

(57) ABSTRACT

An apparatus comprises a frame, a vehicle engagement assembly, a lift actuation assembly, a locking assembly, and an indicator system. The vehicle engagement assembly is designed to vertically lift a vehicle. The frame comprises at least one slot to provide a predetermined path for the vehicle engagement assembly. The lift assembly provides the force required to lift the vehicle while the locking assembly stabilizes the vehicles without further force required by the lift assembly. The indicator system determines whether the locking assembly or the lift assembly is predominantly keeping the vehicle lifted.

8 Claims, 10 Drawing Sheets

(56) References Cited

U.S. PATENT DOCUMENTS 4,662,608 A * 5/1987 Ball ..... E21B 44/00 175/162
4,825,977 A * 5/1989 Isogai ..... B66F 7/02 187/203
4,856,618 A * 8/1989 Isogai ..... B66F 7/04 187/208
4,949,540 A * 8/1990 Wich ..... B66F 7/20 137/99
5,009,287 A 4/1991 Starr
5,362,196 A * 11/1994 Beattie ..... B66F 7/04 254/89 H
5,484,134 A * 1/1996 Francis ..... B66F 7/04 254/2 B
5,540,554 A * 7/1996 Masuzawa ..... F04B 49/065 417/20
6,279,685 B1 * 8/2001 Kogan ..... B66F 7/20 187/203
6,634,461 B1 * 10/2003 Baker ..... B66F 3/46 187/210
6,964,322 B2 11/2005 Green et al.
6,983,196 B2 * 1/2006 Green ..... B66F 7/04 254/45
7,025,178 B2 * 4/2006 Wengelski ..... B60S 9/12 187/244
7,150,073 B2 12/2006 Stewart
8,256,577 B2 * 9/2012 Kritzer ..... B66F 3/46 187/215
8,567,761 B2 * 10/2013 De Jong ..... B66F 3/46 254/134
9,249,000 B2 * 2/2016 Finkbeiner ..... B66F 7/28
2004/0011594 A1 * 1/2004 Stewart ..... B66F 7/28 187/213
2009/0127031 A1 * 5/2009 Corder ..... G01G 19/10 187/393
2009/0242333 A1 * 10/2009 Finkbeiner ..... B66F 3/46 187/209
2010/0274514 A1 * 10/2010 Kamachi ..... G01B 21/26 702/94
2011/0097187 A1 4/2011 Kelley et al.
2015/0232310 A1 * 8/2015 Jaipaul ..... B66F 3/46 414/800
2016/0016768 A1 * 1/2016 Karleskint ..... B66F 7/28 254/133 R

* cited by examiner

LOAD INDICATOR FOR VEHICLE LIFT

PRIORITY

This application claims priority to U.S. Provisional Patent Application Ser. No. 61/993,550, entitled "Load Indicator for Vehicle Lift," filed May 15, 2014, the disclosure of which is incorporated by referenced herein.

BACKGROUND

A vehicle lift is a device operable to lift a vehicle such as a car, truck, bus, etc. Some vehicle lifts operate by positioning arms under the vehicle. The arms may be pivotably coupled with a yoke to support the frame, axle, wheel, or the like of the vehicle. The yoke may be attached to one of two posts. The posts may be fixed in a location on each side of the vehicle. Each yoke may be attached to the posts in such a way that the yokes may actuate up and down on each post relative to the ground. Accordingly, the yokes may be raised or lowered to bring the vehicle to a desired height. Afterward, the vehicle may then be lowered once the user has completed his or her task requiring the vehicle lift. In some cases, the vehicle lift may include a locking mechanism. Such a locking mechanism may prevent the vehicle lift from suddenly dropping a load, by progressively locking the vehicle lift at various heights as the yokes are raised relative to the ground. However, in some locking mechanisms, the locking mechanism of the vehicle lift may not fully engage until the load is lowered slightly. By adding an indicator system to the vehicle lift it may be possible for a user to quickly ascertain whether the vehicle lift is in the locked position (i.e., whether the load is being borne by the locking mechanism).

Examples of vehicle lift devices and related concepts are disclosed in U.S. Pat. No. 6,983,196, entitled "Electronically Controlled Vehicle Lift and Vehicle Services System," issued Jan. 3, 2006, the disclosure of which is incorporated by reference herein; U.S. Pub. No. 2011/0097187, entitled "Vehicle Guidance System for Automotive Lifts," published Apr. 28, 2011, the disclosure of which is incorporated by reference herein; U.S. Pat. No. 5,009,287, entitled "Vehicle Lift," issued Apr. 23, 1991, the disclosure of which is incorporated by reference herein; U.S. Pat. No. 6,964,322, entitled "Method and Apparatus for Synchronizing a Vehicle Lift," issued Nov. 15, 2005, the disclosure of which is incorporated by reference herein; U.S. Pat. No. 7,150,073, entitled "Hinge Pin," issued Dec. 19, 2006, the disclosure of which is incorporated by reference herein; and U.S. Pub. No. 2004/0011594, entitled "Overhead Assembly for Vehicle Lift," published Jan. 22, 2004, the disclosure of which is incorporated by reference herein.

While a variety of vehicle lifts have been made and used, it is believed that no one prior to the inventor(s) has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
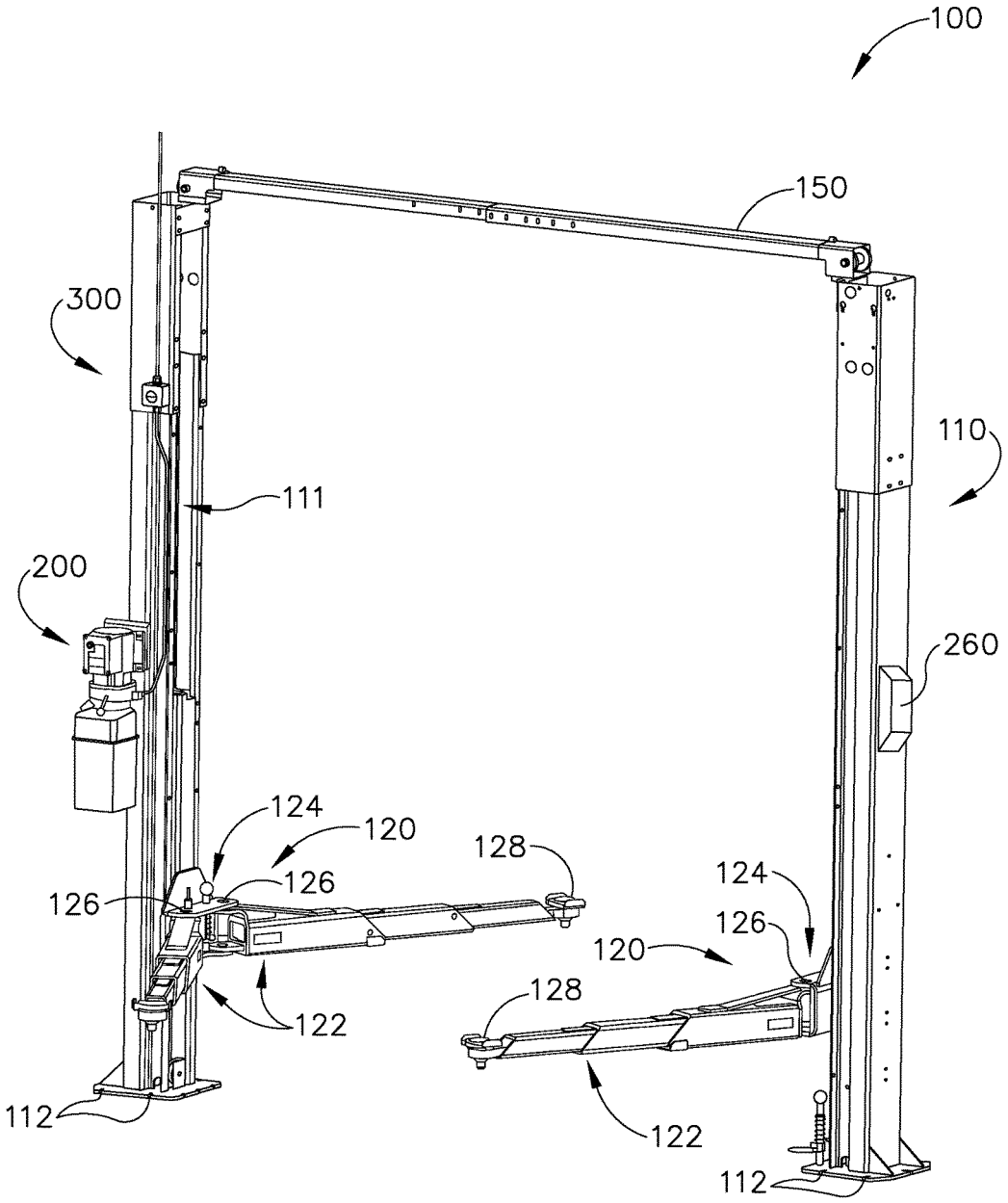
FIG. 1 depicts a perspective view of an exemplary automotive lift.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

FIG. 1 shows an automotive lift (100). Automotive lift (100) comprises two posts (110), two corresponding carriage assemblies (120), an overhead bar assembly (150), a hydraulic lift assembly (200), a lower to lock locking assembly (250), and an indicator system (300). Posts (110) are configured to be mounted to the ground by bolts disposed through bolt holes (112) located on the bottom of each post (110). Posts (110) then extend vertically from the ground. As can be seen, posts (110) generally have a rectangular transverse cross section with a channel (111) in one side. The rectangular shape of posts (110) makes posts (110) substantially rigid. The channel (111) in one side of the cross-section of posts (110) permits each carriage assembly (120) to be actuated hydraulic lift assembly (200), as will be described in greater detail below.

Carriage assemblies (120) are shown has having two arms (122) extending from posts (110) at an angle. The two arms (122) of each carriage assembly (120) are connected to one another by a yoke (124). The proximal end of each arm (122) may connect to yoke (124) by a pin connection (126). Pin connection (126) may permit arms (122) to rotate relative to yoke (124). The distal end of each arm (122) is shown as having a lifting pad (128). Lifting pad (128) is configured to support a vehicle. The rotatabilty of arms (122) about yoke (124) permits each lifting pad (128) to be adjusted to a location on vehicle suitable for lifting such as the frame, axle, or wheel. Arms (122) may be formed by telescoping segments that provide adjustability of the effective length of each arm (122). Thus, the combination of arms (122) being rotatable relative to yoke (124) and the telescoping nature of the arm segments permits vehicle lift system (100) to lift vehicles of varying size, shape, and/or lifting locations.

Posts (110) are aligned to be substantially parallel to each other. The alignment of posts (110) may be maintained by bolts in bolt holes (112). Similarly, the parallel alignment of posts (110) may be maintained by overhead bar assembly (150) mounted on the upper portion of posts (110). Thus, even when a vehicle is supported by arms (122) of carriage assemblies (120), posts (110) may maintain parallel alignment whether carriage assemblies (120) are positioned in a lowered position or raised position relative to the ground. As will be understood, overhead bar assembly (150) may also provides suitable structure to mount assemblies that may be used for an equalization system which stabilizes and levels the carriage assembly (120) on each post (110). Further examples of such automotive lifts (100) having overhead bar assemblies (150) are disclosed in U.S. Provisional Patent Ser. No. 61/940,589, entitled "Adjustable Overhead Assembly for Vehicle Lift," filed Feb. 17, 2014, the disclosure of which is incorporated by reference herein.

Figure 2:
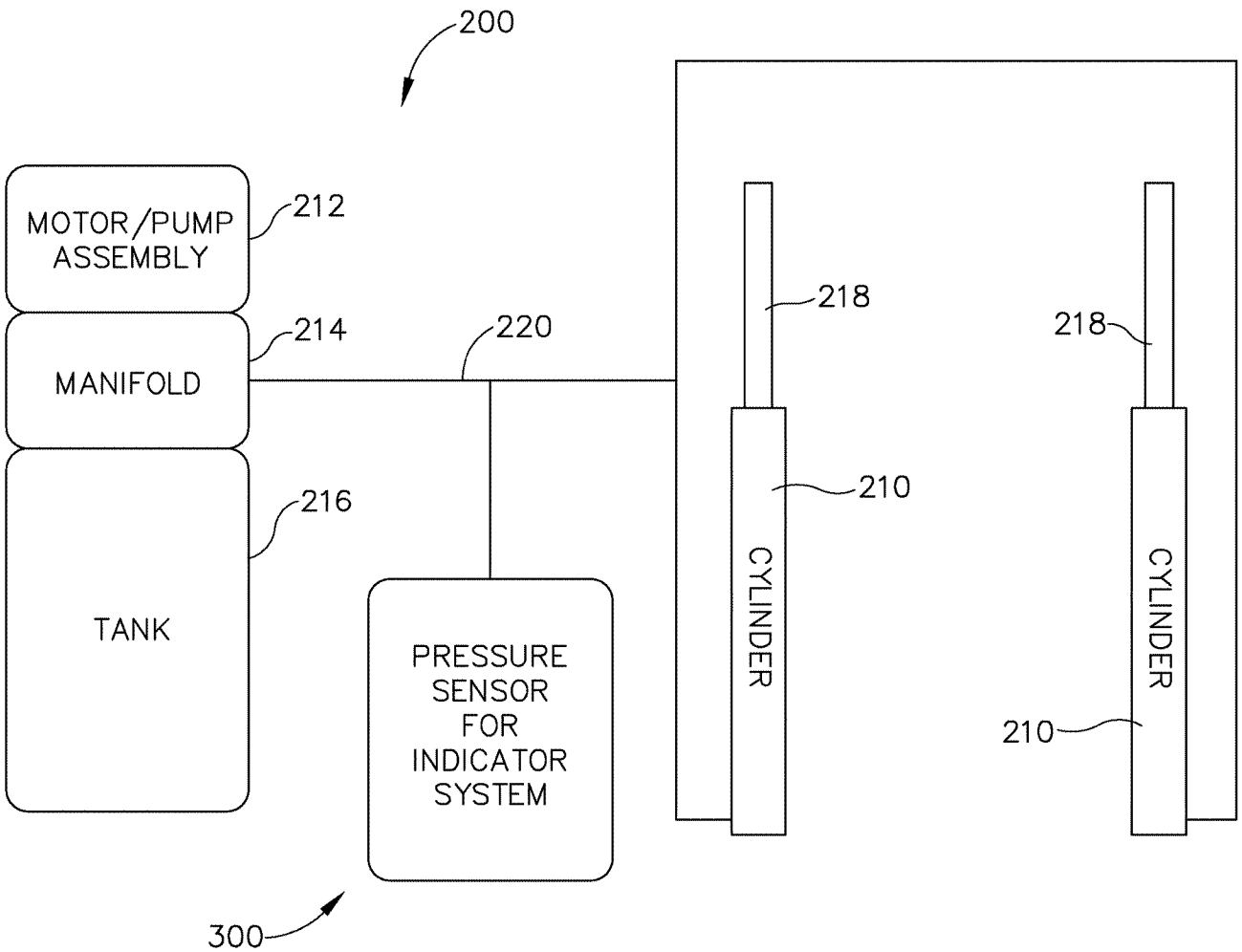
FIG. 2 depicts a schematic view of a hydraulic lift assembly of the automotive lift of FIG. 1.

As described above, carriage assemblies (120) may be actuated by hydraulic lift assembly (200). In particular, hydraulic lift assembly (200) includes a hydraulic cylinder (210) mounted inside posts (110) which is operable to actuate a particular carriage assembly (120) up and down relative to a particular post (110). As can be seen in FIG. 2, hydraulic lift assembly (200) includes hydraulic cylinders (210), a hydraulic pump (212), a manifold (214) and a hydraulic fluid storage tank (216). In the present example, hydraulic cylinders (210) are shown in a push-type hydraulic cylinder (210) configuration. Hydraulic cylinder (210) includes a rod (218) having an integral piston (not shown) that is slidably disposed in hydraulic cylinder (210). In the push type configuration, hydraulic cylinder (210) is operable to push rod (218) via piston (not shown) in an upward direction, toward the top of post (110). The distal end of rod (218) may then attach to carriage assembly (120) thus permitting hydraulic cylinder (210) to actuate carriage assembly (120) up or down. Of course, in other examples, hydraulic cylinder (210) may have a pull-type configuration whereby hydraulic cylinder (210) is mounted in the upper portion of post (110) permitting rod (218) to pull carriage assembly (120) upwardly. When inside post (110), carriage assembly (120) is configured to slide within post (110) by any suitable means such as a linear slide. Thus, carriage assembly (120) may be actuated within post (110) by hydraulic cylinder (210) actuating carriage assembly (120) upwardly or downwardly.

Generally, hydraulic pump (212), manifold (214), and hydraulic fluid storage tank (216) are configured to work cooperatively to actuate hydraulic cylinder (210). For instance, hydraulic pump (212) is configured to pump hydraulic fluid thus pressurizing the fluid within hydraulic lift assembly (200). Likewise, hydraulic fluid storage tank (216) is configured to act as a reservoir, storing excess hydraulic fluid. Manifold acts as a coupling between hydraulic pump (212) and hydraulic fluid storage tank (216) permitting pressurized hydraulic fluid to be communicated through hydraulic lines (220) to hydraulic cylinders (210). Thus, hydraulic pump (212) may pressurize hydraulic fluid contained within hydraulic fluid storage tank (216) forcing the hydraulic fluid through manifold (214) and into hydraulic cylinders (210). As the pressure of the hydraulic fluid in the hydraulic cylinders (210) builds, rods (218) may be forced out of hydraulic cylinders (210) via pistons (not shown). Correspondingly, as carriage assemblies (120) are lowered, fluid is drained from hydraulic cylinders (210) and into hydraulic fluid storage tank (216). It should be understood that any hydraulic lift assembly (200) may be utilize any suitable hydraulic pump (212), manifold (214), or hydraulic fluid storage tank (216) as will be apparent to those of ordinary skill in the art in view of the teachings herein.

Figure 3:
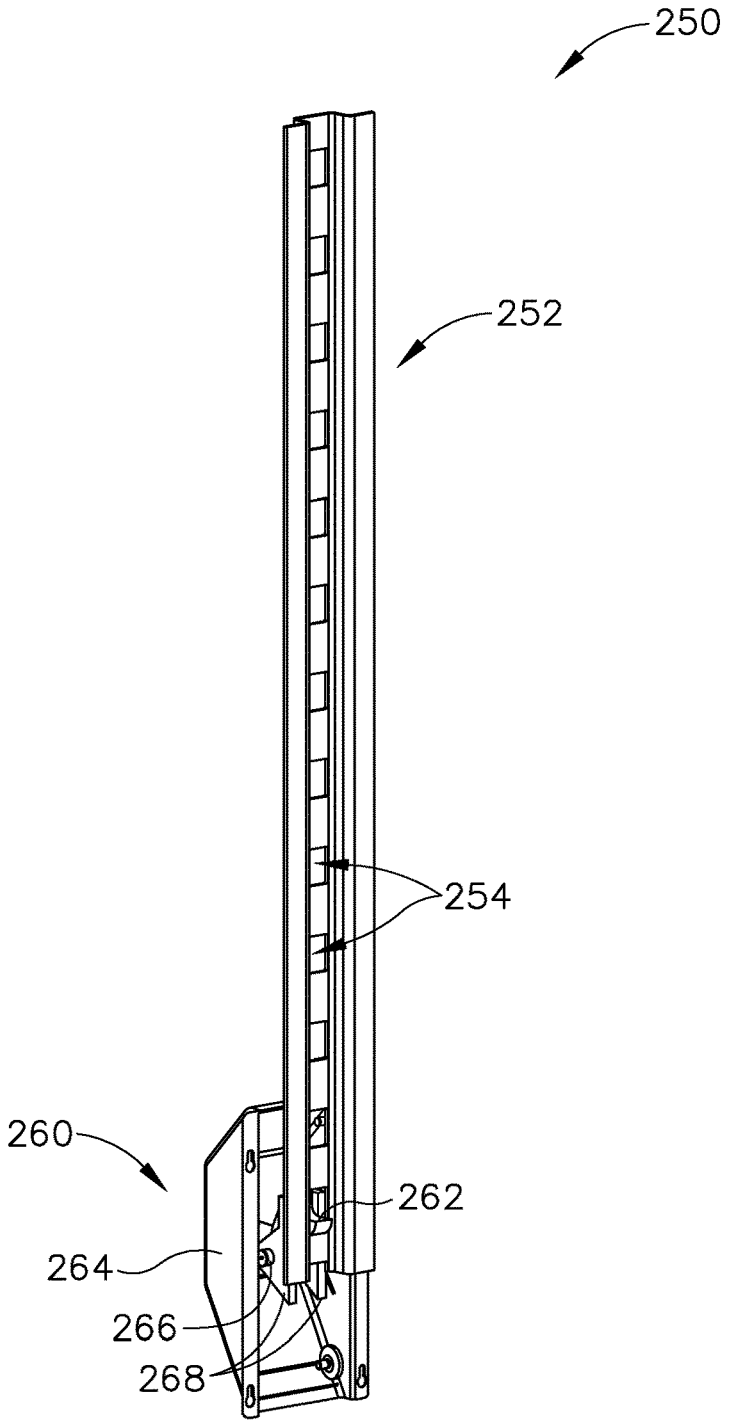
FIG. 3 depicts a perspective view of a lower to lock locking assembly of the automotive lift of FIG. 1.
Figure 4:
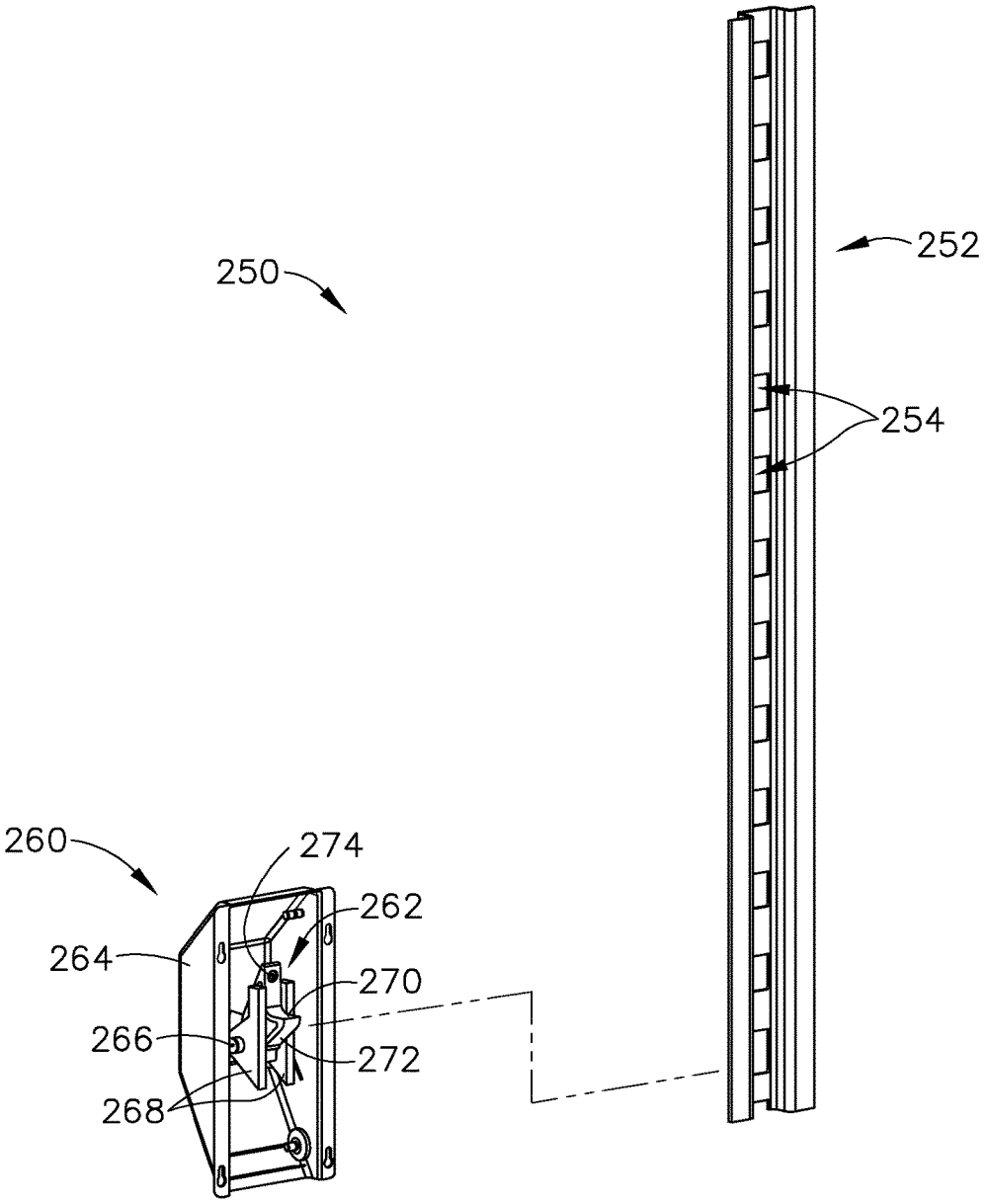
FIG. 4 depicts a partially exploded view of the locking assembly of FIG. 3.

FIGS. 3-4 show a perspective view of locking assembly (250). Locking assembly (250) comprises a lock rail (252) and a lock actuator (260). As will be described in greater detail below, lock rail (252) and lock actuator (260) generally operate together as a safety feature to prevent automobile lift (100) from suddenly releasing a load downwardly, such as in the event of a sudden loss of hydraulic fluid pressure. As will be described in greater detail below, lock rail (252) is attachable to carriage assembly (120) while lock actuator (260) is attachable to post (110). Thus, lock rail (260) moves vertically on carriage assembly (120) relative to lock actuator (260) on post (110). Additionally, each carriage assembly (120) may include a corresponding lock rail (252); and each post (110) may include a corresponding lock actuator (260).

Lock rail (252) is shown as being a long rectangular strip with evenly spaced rectangular holes (254) disposed along the longitudinal length of lock rail (252). As will be described in greater detail below, holes (254) are sized to receive a lock member (262) of lock actuator (260). Lock rail (252) is generally rigid and may be comprised of a material that may provide sufficient rigidity. For instance, lock rail (252) may be comprised of steel, aluminum, iron, brass, or the like. Additionally, lock rail (252) is shown as having a generally u-shaped channel with outwardly extending flanges. Such a shape may provide additional rigidity while also positioning holes (254) closer in proximity to lock actuator (260). In other examples, lock rail (252) may be configured with any suitable shape or material as will be apparent to one of ordinary skill in the art in view of the teachings herein.

As can best be seen in FIG. 4, lock actuator (260) comprises lock member (262), a housing (264), a pivot pin (266) and two support members (268). As will be described in greater detail below, lock actuator (260) is mountable to the outside of post (110). Lock member (262) is pivotable about pivot pin (266). Pivot pin (266) is supported by support members (268) which may be secured to post (110) by welding, adhesive boding, mechanical fastening, and/or the like. Housing (264) may be secured to post (110) over the components of lock actuator (260) to protect the components of lock actuator (260) from dust, dirt, or other debris.

Lock member (262) comprises a lock portion (270) and a cam portion (272). As will be described in greater detail below, lock portion (270) and cam portion (272) are operable to engage holes (254) in lock rail (252). Accordingly, lock portion (270) and cam portion (272) are sized and shaped to correspond to the size and shape of holes (254) in lock rail (252). Additionally, lock member (262) is shown as having a stopper portion (276). Stopper portion (276) is configured to prevent additional pivoting of lock member (262). In particular, stopper portion (276) will contact post (110) as lock member (262) pivots thus preventing lock portion (270) from pivoting below a substantially horizontal plane. Although not shown in FIGS. 3-4, it should be understood that in some examples, lock member (262) may be resiliently biased towards the pivoted position shown in FIG. 4 by a spring or other resiliently biased member.

As described above, lock rail (252) and lock actuator (260) operate cooperatively to ensure that as carriage assembly (120) travels up post (110), carriage assembly (120) is locked from inadvertent lowering. In particular, lock rail (252) attaches to carriage assembly (120) such that lock rail (252) may travel with carriage assembly (120) on the exterior of carriage assembly (120) near the interior of post (110). Similarly, lock actuator (260) is mounted on the exterior of post (110) in alignment with a hole (not shown) in post (110). Accordingly, a portion of lock member (262) (e.g., lock portion (270)) of lock actuator (260) may pivot through post (110) where lock member (262) may engage lock rail (252).

For instance, in an exemplary mode of operation, carriage assembly (120) is moved upwardly by hydraulic cylinder (210) thus moving lock rail (252) upwardly relative to lock actuator (260). As lock rail (252) moves upwardly, a section of lock rail (252) above a particular hole (254) will pivot lock member (262) of lock actuator (260) away from lock rail (252). In the present example, such pivoting is accomplished by engagement with cam portion (272) of lock member (262). Further upward movement of lock rail (252) relative to lock actuator (260) will subsequently position the particular hole (254) adjacent to lock member (262). Once lock the particular hole (254) is adjacent to lock member (262), cam portion (272) of lock member (262) will become disengaged from lock rail (252). When cam portion (272) is disengaged from lock rail (252), lock member (262) will be permitted to pivot into hole (254) of lock rail (252) via the resilient bias described above. With lock member (262) pivoted into hole (254) of lock rail (252), lock portion (270) of lock member (262) may prevent any downward movement of lock rail (252) and carriage assembly (120) via stopper portion (274). Once lock portion (270) of lock member (262) has been positioned pivoted into position within hole (254) of lock rail (252), carriage assembly (120) may then be lowered to fully lock automotive lift (100), such that lock member (262) and lock rail (252) cooperate to bear the weight of the lifted vehicle (instead of the hydraulic fluid circuit of lift assembly (200) bearing the weight). Alternatively, carriage assembly (120) may continue to raise thereby pivoting lock member (262) out of hole (254) via the next subsequent portion of lock rail (252).

Thus, according to the above description, locking assembly (250) has the characteristics of a ratchet type mechanism. In particular, as carriage assembly (120) is actuated upwardly relative to post (110), locking assembly (250) acts to lock carriage assembly (120) at progressively higher heights. Accordingly, if hydraulic cylinder (210) were to suddenly lose fluid pressure, carriage assembly (120) would only fall to the lowest next hole (254) on lock rail (252). However, it should be understood that automotive lift (100) is in a fully locked position when carriage assembly (120) has been lowered to fully engage lock member (262) of lock actuator (260) with hole (254) of lock rail (252). Although certain structures and modes of operation for locking downward motion of carriage assembly (120) are shown, it should be understood that any other suitable structure or method of operation may be utilized as will be apparent to those of ordinary skill in the art in view of the teachings herein.

As described above, automotive lift (100) is in the fully locked position when carriage assemblies (120) have been lowered to fully engage locking assemblies (250). When in this position, the hydraulic fluid in hydraulic cylinders (210) may be at least partially relieved of pressure. In other words, the load carried by automotive lift (100) may be shifted from being supported by hydraulic cylinders (210) to being at least partially supported by locking assemblies (250). Accordingly, pressure in hydraulic cylinders (210) and the rest of the hydraulic circuit may act to indicate whether automotive lift (100) is in a locked state. When the pressure in the hydraulic circuit is relatively high, this may indicate that the hydraulic circuit is bearing the weight of the lifted vehicle, which may further indicate that automotive lift (100) is in an unlocked state. When the pressure in the hydraulic circuit is relatively low, this may indicate that the mechanical components of locking assembly (250) are bearing the weight of the lifted vehicle, which may further indicate that automotive lift (100) is in a locked state.

Locking assembly (200) may also include an unlocking feature (not shown), which is coupled with lock member (262), that may permit automotive lift (100) to provide intentional, controlled lowering of the vehicle. In particular, when lift assembly (200) is activated to intentionally lower the vehicle, lock member (262) is actuated by the unlocking feature to pivot away from lock rail (252). Lock member (262) is pivoted away from lock rail (252) by the unlocking feature such that lock member (262) does not impede intentional, controlled lowering of the vehicle. A suitable unlocking feature may comprise any suitable mechanism such as a solenoid, a motor or manually actuated cable, or the like.

Figure 5:
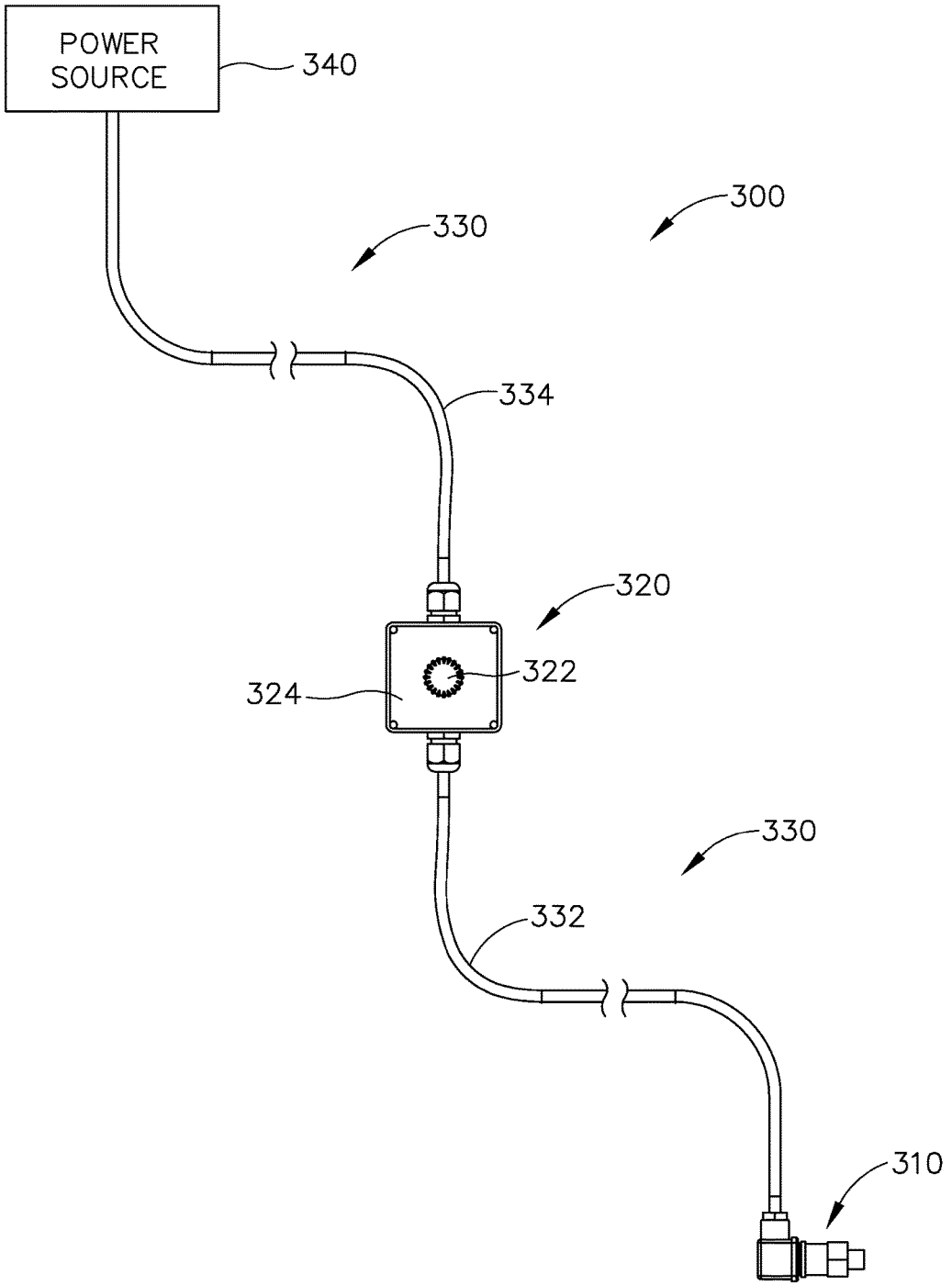
FIG. 5 depicts a front plan view of an indicator system of the hydraulic lift assembly of FIG. 2.

FIG. 5 depicts an exemplary indicator system (300). Indicator system (300) comprises a pressure sensor (310), an indicator (320) and a wire harness (330). Returning to FIG. 2, a pressure sensor (310) is shown as being attached to hydraulic line (220) such that the pressure of the hydraulic fluid may be measured. In the present example, pressure sensor (310) is an binary electronic switch that is configured to have a closed circuit when the pressure is below a certain threshold and have an open circuit when the pressure is above a certain threshold. It should be understood that the specific pressure threshold which pressure sensor (310) is responsive to may vary depending upon the type of load automotive lift (100) is designed to lift and the particular design of hydraulic cylinders (210). Accordingly, pressure sensor (310) may utilize any pressure threshold will as will be apparent to those of ordinary skill in the art in view of the teachings herein. Alternatively, pressure sensor (310) may be configured to sense various pressures and communicate pressure data to a control module or processor in indicator (320). The control module or processor may be configured to respond when the pressure is above or below a certain value; or inside/outside a predetermined range.

Indicator (320) comprises a single light (322) mounted in a junction box (324). Light (322) is may be any suitable light such as an incandescent, halogen, LED, florescent, and/or etc. Additionally, light (322) may be configured to have a certain color that may provide additional meaning as will be described in greater detail below. Light (322) is shown as being mounted to junction box (324). Junction box (324) provides a connection between a first run (332) of wire harness (330) and light (322). Additionally, junction box (324) provides a connection between second run (334) of wire harness (330) and light (322), as will be described in greater detail below. In the present example, wire harness (330) is comprised of wire suitable for carrying the electric current necessary to power light (322). As can best be seen in FIG. 1, indicator (320) may be mounted to post (110) in a position that maximizes visibility of light (322). Of course, the particular positioning of indicator (320) shown in FIG. 1 is merely an example and other versions may place indicator (320) elsewhere on post (110) or even on other objects not shown in FIG. 1 (e.g., support structures and/or walls of a shop).

As can be seen in FIG. 5, pressure sensor (310) is in electrical communication with light (322) via first run (332) of wire harness (330). Both light (322) and pressure sensor (310) are in communication with a power source (340) coupled to the end of second run (334) of wire harness (330). Thus, pressure sensor (310) is operable to switch light (322) on or off depending on the pressure applied to hydraulic line (220). In the example depicted, pressure sensor (310) may simply switch from a closed state to an open state when a certain amount of pressure above a predetermined pressure threshold is applied. Light (322) is wired in series with pressure sensor (310). Thus when pressure sensor (310) is in a closed state, a circuit between power source (340), light (322) and pressure sensor (310) is completed, illuminating light (322). Although indicator system (300) is described as having relatively simple circuitry, it should be understood that no such limitation is intended. For instance, pressure sensor (310) may be a more complex sensor capable of dynamically monitoring pressure continuously by use of a transducer. With such a pressure sensor (310), digital components may be incorporated into pressure sensor (310) to achieve pressure monitoring over time. Accordingly, light (322) may be connected to pressure sensor (310) by more complex circuitry to facilitate the on and off states of light (322) in response to pressure changes.

Figure 6:
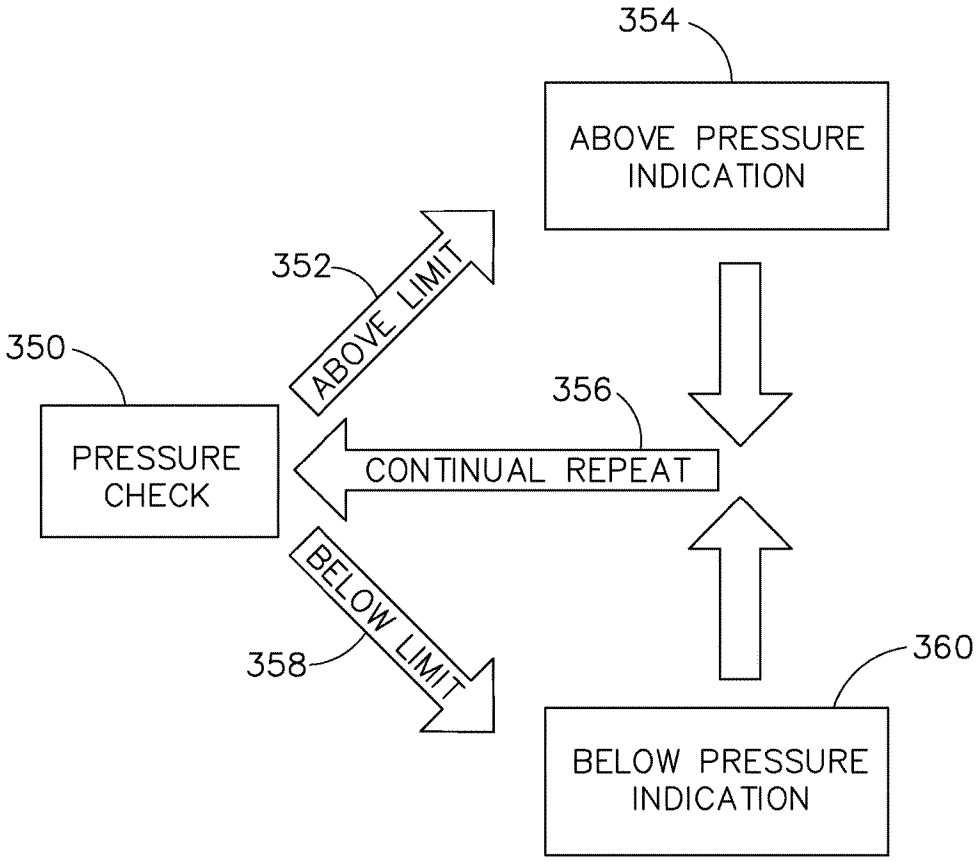
FIG. 6 depicts a flow chart showing an exemplary process that may be carried out sing the indicator system of FIG. 5.

FIG. 6 shows a flow chart of an exemplary mode of operation of indicator system (300). Regardless of the circuitry involved between pressure sensor (310) and light (322), indicator system (300) operates in generally the same way. Pressure is continuously measured (block 350) by pressure sensor (310) to determine if the pressure in hydraulic line (220) is above or below a predetermined threshold. If the pressure is above a predetermined threshold (arrow 352), indicator system (300) triggers indicator (320) to provide an indication that the fluid pressure level is above the threshold (block 354). In some versions, this is accomplished by illuminating light (322), where the illumination of light (322) provides a readily viewable indication that the fluid pressure level is above the threshold. In some other versions, indicator system (300) provides an indication that the fluid pressure level is above the threshold by de-illuminating or darkening light (322). In either case, indicator (320) may indicate that automotive lift (100) is in an unlocked state (e.g., load bearing on the hydraulic circuit instead of locking assembly (250)) in block (354).

Continuing with the process shown in FIG. 6, as pressure sensor (310) continues to monitor pressure (arrow 356), pressure may drop below the predetermined threshold (arrow 358). If the pressure is below the predetermined threshold (arrow 358), indicator system (300) triggers indicator (320) to provide an indication that the fluid pressure level is below the threshold (block 360). In some versions, this is accomplished by illuminating light (322), where the illumination of light (322) provides a readily viewable indication that the fluid pressure level is below the threshold. In some other versions, indicator system (300) provides an indication that the fluid pressure level is below the threshold by de-illuminating or darkening light (322). In either case, indicator (320) may indicate that automotive lift (100) is in a locked state (e.g., load bearing on locking assembly (250) instead of the hydraulic circuit) in block (360).

It should be understood from the foregoing that indicator system (300) is operable to provide a visual indicator to a user of automotive lift (100) as to whether automotive lift (100) is in a locked state. For instance, an illuminated light (322) may be used to indicate either a locked state of automotive lift (100) or an unlocked state of automotive lift (100). In a shop environment utilizing several automotive lifts (100), a user may be a supervisor quickly verifying that all lifts in the shop are in a locked state when persons are underneath any raised vehicles.

As noted above, indicator system (300) may use a single light (322) to indicate the locked state of automotive lift (100); or a single light (322) to indicate an unlocked state. For instance, light (322) may emit red light to indicate that a user should stop and lock the lift when automotive lift (100) is unlocked. In other examples, indicator system (300) may include a wired or wireless computer network interface which may permit indicator system (300) to be connected to a local area network, or the internet. In such an example, the locked or unlocked condition may be remotely monitored by a user (e.g., supervisor in the back office of a shop). In yet other examples, the number of lights (322) may be varied, as will be described in greater detail below. In still other examples, indicator (320) may include other types of indications besides lights such as buzzers, chimes, bells, and/or etc. Of course any other method of indicating the status of the automotive lift (300) may be used as will be apparent to those of ordinary skill in the art in view of the teachings herein.

It should be also understood that indicator system (300) may be utilized with other types of automotive lifts (100). For instance, automotive lift (100) may contain additional posts (110) (e.g., four post lift) with one or more posts utilizing hydraulic cylinders (210) to lift a vehicle. Indicator system (300) may be similarly incorporated with inground lifts, scissor-lifts, Y-lifts, match (WEMU) lifts, parallelogram lifts, and/or etc. Of course, such lifts may utilize hydraulic cylinders (210) or any other type of hydraulic actuation mechanisms. In some versions, cylinders (210) are mounted in the runway of a lift, on a leg assembly, and/or elsewhere within a lift system. It should also be understood that an indicator (320) may be directly mounted in a control box or other housing, in any suitable location, and that a junction box is not necessarily required for indicator (320). Other configurations may be utilized as will be apparent to those of ordinary skill in the art in view of the teachings herein.

Figure 7:
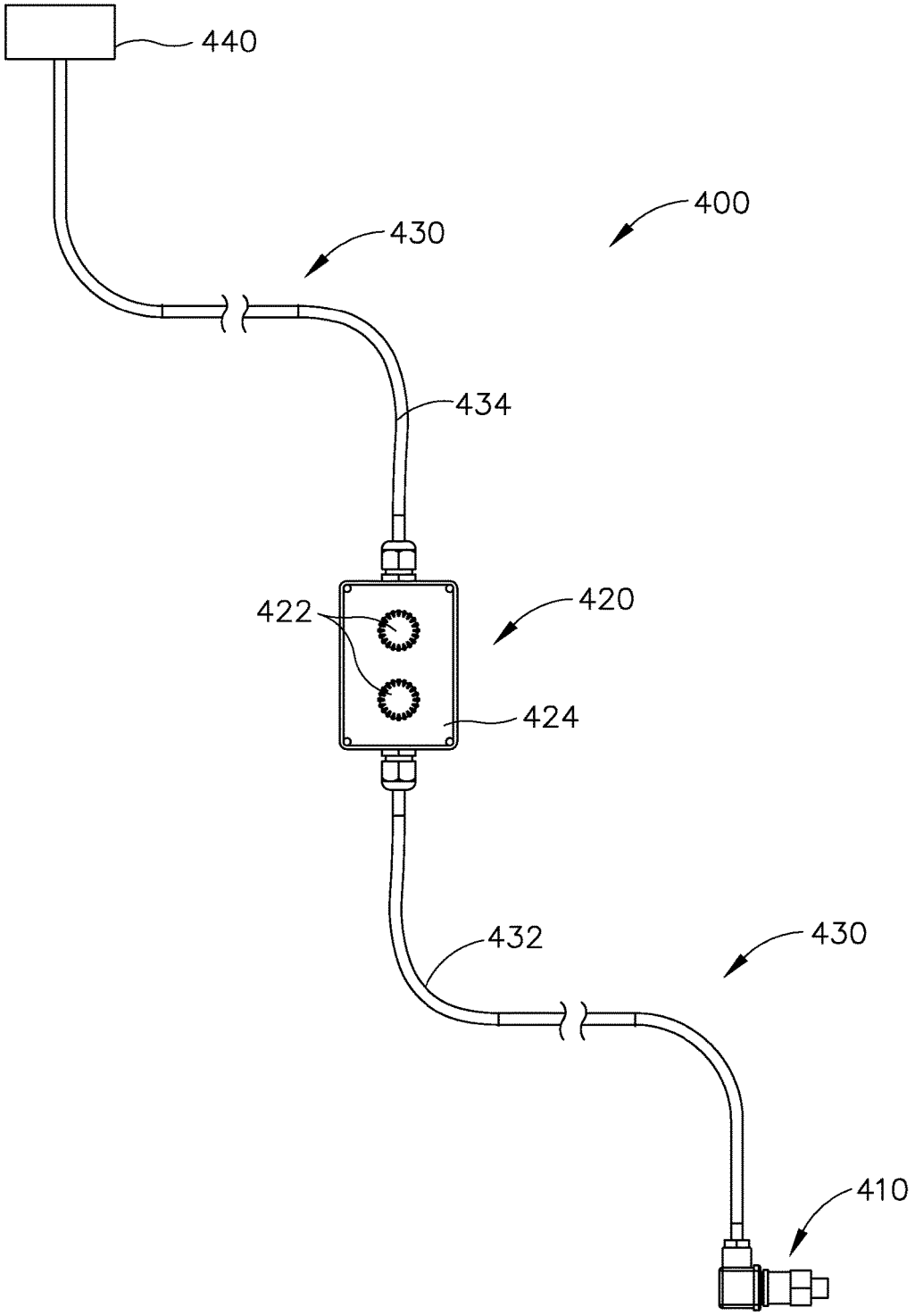
FIG. 7 depicts a front plan view of an exemplary alternative indicator system that may be incorporated into the automotive lift of FIG. 1, with a two indicator lights.

FIG. 7 shows an exemplary alternative indicator system (400) that may be incorporated into automotive lift (100). Indicator system (400) comprises pressure sensor (410), indicator (420), wire harness (430), and power source (440). The structure and function of indicator system (400) is substantially the same as indicator system (300), described above. However, unlike indicator system (300), indicator system (400) comprises two lights (422) mounted in junction box (324) of indicator (420). In this configuration, each light (422) may be separately wired such that one light (422) may indicate one state of automotive lift (100) while another light (422) may indicate another state of automotive lift (100). Additionally, lights (422) may be color coded to provide an additional indication of state. By way of example only, one light (422) may be colored red and may be illuminated when automotive lift (100) is in an unlocked state. Similarly, another light (422) may be colored green and may be illuminated when automotive lift (100) is in a locked state. Of course any other color code may be utilized as will be apparent to those of ordinary skill in the art in view of the teachings herein.

Figure 8:
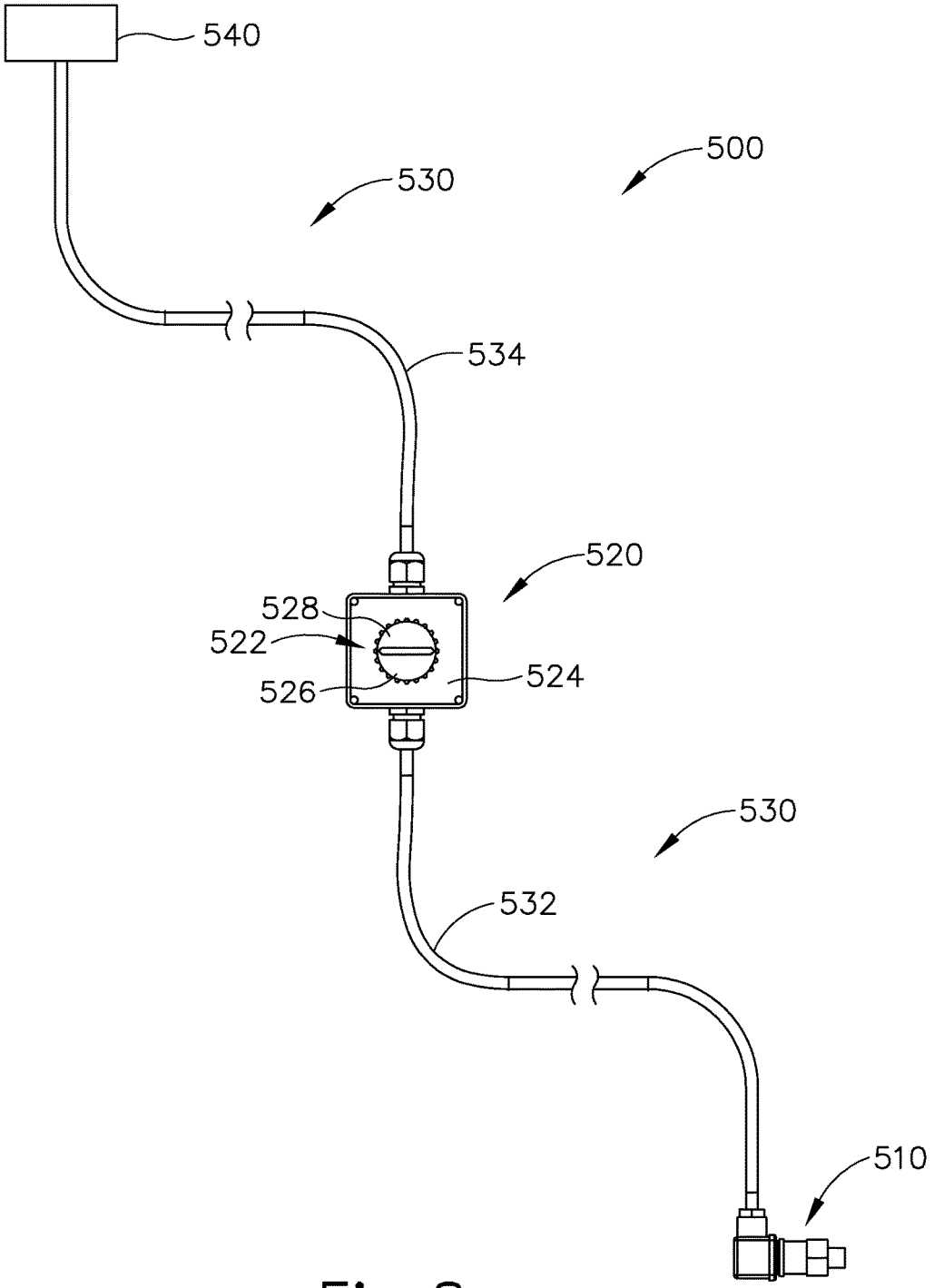
FIG. 8 depicts a front plan view of an exemplary alternative indicator system that may be incorporated into the automotive lift of FIG. 1, with a bi-color indicator light.

FIG. 8 shows an exemplary alternative indicator system (500) that may be incorporated into automotive lift (100). Indicator system (500) comprises pressure sensor (510), indicator (520), wire harness (530), and power source (540). The structure and function of indicator system (500) is substantially the same as indicator system (300), described above. However, unlike indicator system (300), indicator system (400) comprises a single light (522) having two illuminating surfaces (526, 528) mounted in junction box (324) of indicator (420). In this configuration, light (522) operates in much that same way as lights (422), but only a single light (522) is used. For instance, each illuminating surface (526, 528) may be separately illuminated. Thus, light (522) may be separately wired such that illuminating surface (526) may indicate one state of automotive lift (100) while another illuminating surface (528) may indicate another state of automotive lift (100). Additionally, illuminating surfaces (526, 528) may be color coded to provide an additional indication of state. By way of example only, one illuminating surface (526) may be colored red and may be illuminated when automotive lift (100) is in an unlocked state. Similarly, the other illuminating surface (528) may be colored green and may be illuminated when automotive lift (100) is in a locked state. Of course any other color code may be utilized as will be apparent to those of ordinary skill in the art in view of the teachings herein.

Figure 9:
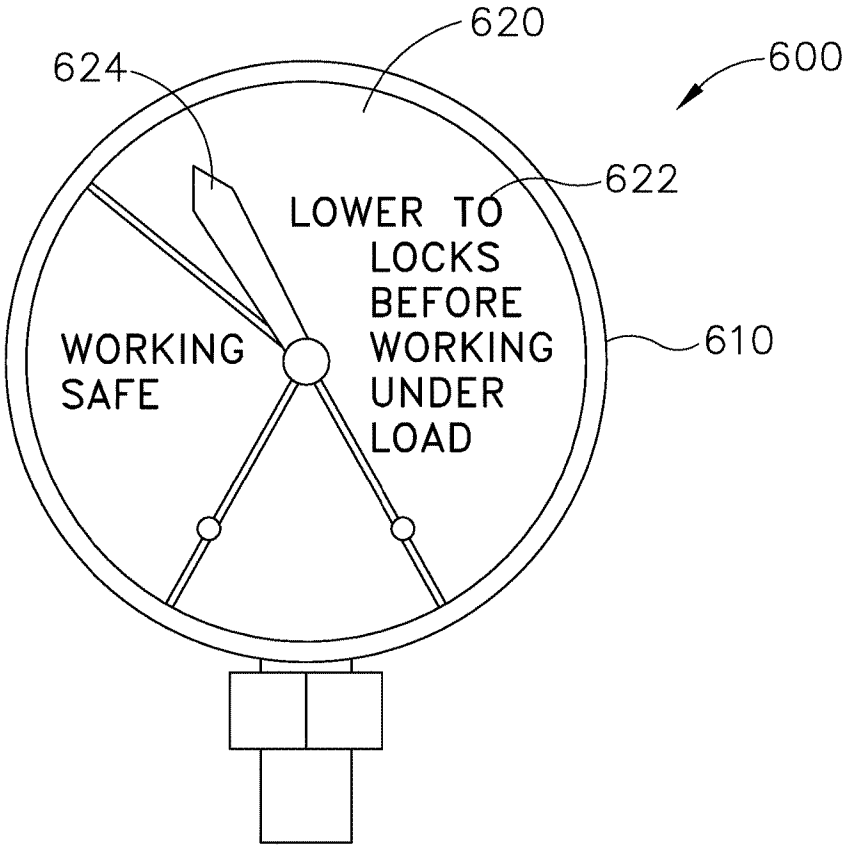
FIG. 9 depicts a front plan view of an exemplary alternative indicator system that may be incorporated into the automotive lift of FIG. 1, with an analog dial gauge.

FIG. 9 shows an exemplary alternative indicator system (600) that may be incorporated into automotive lift (100). Indicator system (600) has a similar function as indicator system (300, 400, 500) with indicator system (600) connecting to hydraulic line (220) and using pressure to indicate an locked or unlocked condition. However, unlike indicator system (300, 400, 500), indicator system (600) is entirely analog. In particular, indicator system (600) incorporates an indicator (620) and pressure sensor (610) into a single assembly. Pressure sensor (610) is similar to a typical mechanical analog pressure gauge which may use an internal bourdon tube attached to gears to actuate an indicator needle (624). As can be seen, indicator includes indicia (622) to indicate whether a locked (relatively low pressure) or unlocked (relatively high pressure) condition is present. In some examples, indicator (620) may also be larger than the gauge of a typical mechanical pressure gauge to improve readability, particularly at a distance from indicator (620).

Figure 10:
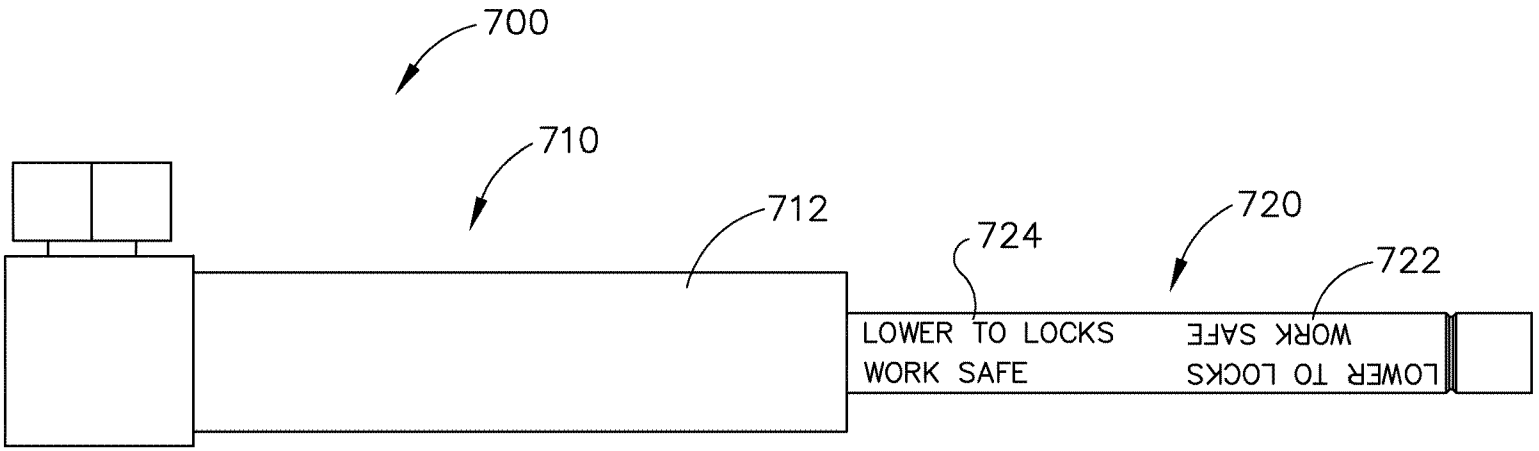
FIG. 10 depicts a front plan view of an exemplary alternative indicator system that may be incorporated into the automotive lift of FIG. 1, with an analog stick gauge.

FIG. 10 shows an exemplary alternative indicator system (700) that may be incorporated into automotive lift (100). Indicator system (700) is similar to indicator system (600) in the sense that indicator system (700) is an entirely analog means of connecting indicating an unlocked or locked condition via the pressure in hydraulic line (220). However, unlike indicator system (600), indicator system (700) utilizes a stick gauge (720) to indicate the pressure reading by pressure sensor (710). Pressure sensor (710) is similar to a typical stick pressure gauge which may utilize a spring loaded piston or resilient bellows to permit the indicator (720) to be projected outwardly thereby indicating pressure. In particular, pressure sensor (710) comprises a cylinder (712) and indicator (720) comprises a slider (724). Slider (724) slides relative to cylinder (712) based on fluid pressure. Indicator (720) may also include indicia (722) to indicate to a user whether automotive lift (100) is in a locked or unlocked condition. Of course, like with indicator system (600), indicator system (700) may utilize an oversized indicator (720) to improve readability of indicator (720).

While the examples above are provided in the context of an above-ground two-post lift, it should be understood that the teachings herein may be readily applied to various other kinds of vehicle lifts. By way of example only, the teachings herein may be readily applied to single post in-ground lifts, two post in-ground lifts, scissor lifts, platform lifts, mobile column lifts, Y-lifts, parallelogram lifts, four post lifts above-ground lifts, and/or any other suitable kind of lift.

It should be understood that any one or more of the teachings, expressions, embodiments, examples, etc. described herein may be combined with any one or more of the other teachings, expressions, embodiments, examples, etc. that are described herein. The following-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. An apparatus for lifting vehicles, the apparatus comprising:

(a) a frame;

(b) a vehicle engagement assembly configured to actuate relative to the frame, wherein the vehicle engagement assembly is configured to vertically lift a vehicle;

(c) a lift actuation assembly configured to support the vehicle via the vehicle engagement assembly and to actuate the vehicle engagement assembly relative to the frame thereby driving the vehicle engagement assembly to vertically lift the vehicle, wherein the lift actuation assembly comprises a hydraulic circuit;

(d) a locking assembly configured to support the vehicle and to selectively maintain a position of the vehicle engagement assembly relative to the frame without assistance of the hydraulic circuit; and (e) an indicator system in fluid communication with the hydraulic circuit, wherein the indicator system is configured to determine fluid pressure within the hydraulic circuit, wherein the indicator system is configured to binarily transition between a first indicating state and a second indicating state as a binary function of the fluid pressure within the hydraulic circuit, the indicator is configured to indicate the first indicating state when the locking assembly supports the vehicle, and the indicator is configured to indicate the second indicating state when the hydraulic lifting assembly supports the vehicle, to thereby indicate when either the hydraulic circuit is supporting the vehicle or the locking assembly is supporting the vehicle.

2. The apparatus of claim 1, wherein the locking assembly further comprises:
(i) a locking rail, and
(ii) a lock actuator further comprising:
(A) a pivot pin fixed to a housing, and
(B) a lock member pivotably secured to the pivot pin, the lock member further comprising a cam portion configured to rotate the lock member by engaging the locking rail, and a lock portion configured to support the vehicle and to selectively maintain the position of the vehicle engagement assembly relative to the frame without assistance of the lift actuation assembly.

3. The apparatus of claim 2, wherein the locking rail is fixed to the vehicle engagement assembly.

4. The apparatus of claim 1, wherein the hydraulic circuit comprises:
(i) a hydraulic pump,
(ii) a reservoir tank configured to store an amount of hydraulic fluid,
(iii) a manifold connecting the hydraulic pump and the reservoir tank,
(iv) a hydraulic cylinder, and
(v) a hydraulic line connecting the manifold with the hydraulic cylinder.

5. The apparatus of claim 2, wherein the lock member is resiliently biased to engage the lock rail.

6. The apparatus of claim 3, wherein the locking rail further comprises a plurality of apertures.

7. An apparatus for lifting vehicles, the apparatus comprising:
(a) a vehicle engagement assembly configured to vertically raise a vehicle;
(b) a hydraulic lifting assembly configured to support the vehicle and to actuate the vehicle engagement assembly, wherein the hydraulic lifting assembly further comprises a hydraulic circuit comprising:
(i) a hydraulic pump, and
(ii) a hydraulic cylinder in fluid communication with the hydraulic pump, wherein the hydraulic cylinder is further coupled with the vehicle engagement assembly such that the hydraulic lifting assembly is operable to drive the vehicle engagement assembly via the hydraulic cylinder;
(c) a locking assembly configured to support the vehicle and to selectively maintain a vertical position of the vehicle engagement assembly without assistance of the hydraulic lifting assembly; and
(d) an indicator system comprising:
(i) a pressure sensor connected with the hydraulic circuit, wherein the pressure sensor is configured to sense a pressure value within the hydraulic circuit, and,
(ii) an indicator in communication with the pressure sensor, wherein the indicator comprises a binary electric switch in communication with the pressure sensor, wherein the binary electric switch is configured to transition the indicator between a first indication state and a second indication state based on the sensed pressure value, wherein the indicator is configured to indicate the first indicating state when the locking assembly supports the vehicle, and wherein the indicator is configured to indicate the second indicating state when the hydraulic lifting assembly supports the vehicle.

8. An apparatus for lifting vehicles, the apparatus comprising:
(a) a frame assembly, wherein the frame assembly is configured to be fixed relative to the ground;
(b) a vehicle support assembly coupled with the frame assembly, wherein the vehicle support assembly is configured to engage and support a vehicle, wherein the vehicle support assembly is movable relative to the frame assembly to lift the vehicle relative to the ground;
(c) a hydraulic actuation assembly coupled with the vehicle support assembly, wherein the hydraulic actuation assembly is operable to drive the vehicle support assembly upwardly relative to the ground;
(d) a locking assembly operable to selectively engage the frame assembly, wherein the locking assembly is configured to cooperate with the frame assembly and the vehicle support assembly to support the vehicle without the hydraulic actuation assembly bearing the weight of the vehicle; and
(e) an indicator in fluid communication with the hydraulic actuation assembly, wherein the indicator comprises:
(i) a pressure sensor comprising a threshold pressure value, wherein the pressure sensor is configured to sense a pressure of fluid within the hydraulic actuation assembly,
(ii) a lock light indication assembly, and
(iii) a binary electric switch in electrical communication with the lock light indication assembly and the pressure sensor, wherein the binary electric switch is configured to transition the lock light indication assembly between a first indicating state and a second indicating state based on a comparison of the sensed pressure fluid and the threshold pressure value, wherein the first indicating state indicates the locking assembly is bearing the weight of the vehicle, wherein the second indicating state indicates the hydraulic actuating assembly is supporting the vehicle.

* * * * *